US005151740A

United States Patent [19]

Fujimoto

[11] Patent Number: 5,151,740

[45] Date of Patent: Sep. 29, 1992

[54] IMAGE FORMING APPARATUS CAPABLE OF AUTOMATIC CONTROL OF DEVELOPER DENSITY

[75] Inventor: Hitoshi Fujimoto, Tokyo, Japan

[73] Assignee: Kabushiki Kaisha Toshiba, Kawasaki, Japan

[21] Appl. No.: 691,403

[22] Filed: Apr. 25, 1991

[30] Foreign Application Priority Data

Apr. 27, 1990 [JP] Japan ..... 2-114858

[51] Int. Cl.[5] ..... G03G 21/00

[52] U.S. Cl. ..... 355/246; 118/688; 355/69; 355/208; 355/260

[58] Field of Search ..... 355/69, 246, 200, 204, 355/208, 260; 118/688, 689, 690, 691

[56] References Cited

U.S. PATENT DOCUMENTS 4,462,680 7/1984 Ikeda ..... 355/246
4,883,019 11/1989 Menjo et al. ..... 355/246 X
4,956,669 9/1990 Nakamura ..... 355/208
5,053,816 10/1991 Takahashi ..... 355/208

FOREIGN PATENT DOCUMENTS 0030566 2/1984 Japan ..... 355/246
0142772 6/1989 Japan ..... 355/246

OTHER PUBLICATIONS

IBM Technical Disclosure Bulletin, Sep. 1972, vol. 15, No. 4.

*Primary Examiner*—A. T. Grimley
*Assistant Examiner*—P. Stanzione
*Attorney, Agent, or Firm*—Foley & Lardner

[57] ABSTRACT

An image forming apparatus having a section detachably installed in the image forming apparatus, for performing development by supplying developer to an image carrier, a section for detecting the density of the developer on the image carrier so as to control the density of the developer to be a predetermined value when the developing section is installed in the image forming apparatus, the detecting section includes, a section for generating light so as to radiate the generated light to the image carrier, means for detecting the light radiated to and from the image carrier by the generating means, means for controlling an amount of the light from the generating means in response to a result of detection of the light detected by the detecting means.

9 Claims, 11 Drawing Sheets

| 7-SEGMENT DISPLAY | DISPLAY ITEMS | OPERATOR CALL (1) | OPERATOR CALL (2) | OPERATOR CALL (3) | OPERATOR CALL (4) |
|---|---|---|---|---|---|
| 02 ON | A PRELIMINARY ANNOUNCEMENT OF USABLE TERM END OF PROCESS UNIT | ○ | — | — | ○ |
| 03 ON | A PRELIMINARY ANNOUNCEMENT OF USABLE TERM END OF BOTH OF THE FUSER AND THE PROCESS UNIT | ○ | — | — | ○ |
| 20 ON | THE TONER HOPPER ISN'T INSTALLED | ○ | — | ○ | — |
| 22 ON | THE PROCESS UNIT ISN'T INSTALLED | ○ | — | ○ | — |
| 23 ON | THE ELECTROSTATIC CHARGER ISN'T INSTALLED | — | ○ | — | ○ |
| 24 ON | THE TRANSFER CHARGER ISN'T INSTALLED | — | ○ | — | ○ |
| 30 ON | THERE IS NO TONER IN THE TONER HOPPER | — | ○ | ○ | — |
| 51 ON | THE END OF USABLE TERM OF PROCESS UNIT | ○ | — | — | ○ |

FIG. 6

| ADDRESS | REGISTER NAME | FUNCTION | SET UP CONDITIONS | DEFAULT VALUE |
|---|---|---|---|---|
| 04 | TNSI 0 | THE INITIAL VALUE OF TONER SENSOR AND THE COUNT OF TONER NEAR EMPTY | THE TIMING OF CHANGING NEW CARTRIDGE AND NEAR EMPTY | 0~7=571<br>8~13=30 |
| 08 | PRCSC 0 | THE COUNT OF PROCESS TERM, COUNTING ONE PER TOTALC 50 | | 0~7=00<br>0~13=00 |
| 09 | PRCSC 1 | | | |
| 0A | DVC 0 | THE COUNT OF PROCESS UNIT LIFE, COUNTING ONE PER TOTALC 50 | | 0~7=00<br>8~13=00 |
| 0B | DVC 1 | | | |
| 0E | PCI 0 | THE COUNT OF THE PROGRAM SEQUENCE OF JUDGING NEW OR OLD OF THE CARTRIDGE | THE TIME OF JUDGING NEW OR OLD OF THE CARTRIDGE IN INITIALIZING TERM | 0~7=00<br>8~13=00 |
| 0F | PCI 1 | | | |

FIG. 7

IMAGE FORMING APPARATUS CAPABLE OF AUTOMATIC CONTROL OF DEVELOPER DENSITY

BACKGROUND OF THE INVENTION

1. Field of the Invention

The present invention relates to an image forming apparatus and, more particularly, to an image forming apparatus having a developing means wherein the developing means or the like, housing a two-component developer, can be mounted on and detached from the apparatus main body.

2. Description of the Related Art

In an image forming apparatus of this type, a reference developing means is mounted upon the assembly or adjustment of the apparatus main body. A value (voltage) manually input to a toner density detecting means is varied by means of a volume control or the like. As a result, a detection result (voltage) fed back from the toner density detecting means to a control means for performing operation control of the developing means is set to be constant, thus stabilizing the developing operation of he developing means.

However, when an apparatus of this type is used, the input value must be manually adjusted by means of a volume control or the like every time the developing means is exchanged with a new one, resulting in a cumbersome operation.

SUMMARY OF THE INVENTION

It is an object of the present invention to provide an image forming apparatus capable of automatic control of developer density.

The present invention provides an image forming apparatus having a means, detachably installed in the image forming apparatus, for performing development by means of supplying developer to an image carrier, means for detecting a density of the developer on the image carrier so as to control the density of the developer to be a predetermined value when the developing means is installed in said image forming apparatus, the detecting means includes, means for generating light so as to radiate the generated light to the image carrier, means for detecting the light radiated to and from the image carrier by the generating means, means for controlling an amount of the light from the generating means in response to a result of detection of the light detected by the detecting means.

According to the present invention, with the structure described above, the control means performs automatic corrections by controlling the detecting operation of the detecting means such that the detection value obtained by the detecting means falls within a predetermined range for each developing means mounted on the apparatus main body.

As a result, the density detecting means need not be adjusted upon exchange of a developing means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 6 is a table for explaining operator calls;

FIG. 7 is a table for explaining area allocation of a ROMB;

DETAILED DESCRIPTION OF THE PREFERRED EMBODIMENTS

An embodiment of the present invention will be described.

Figure 1:
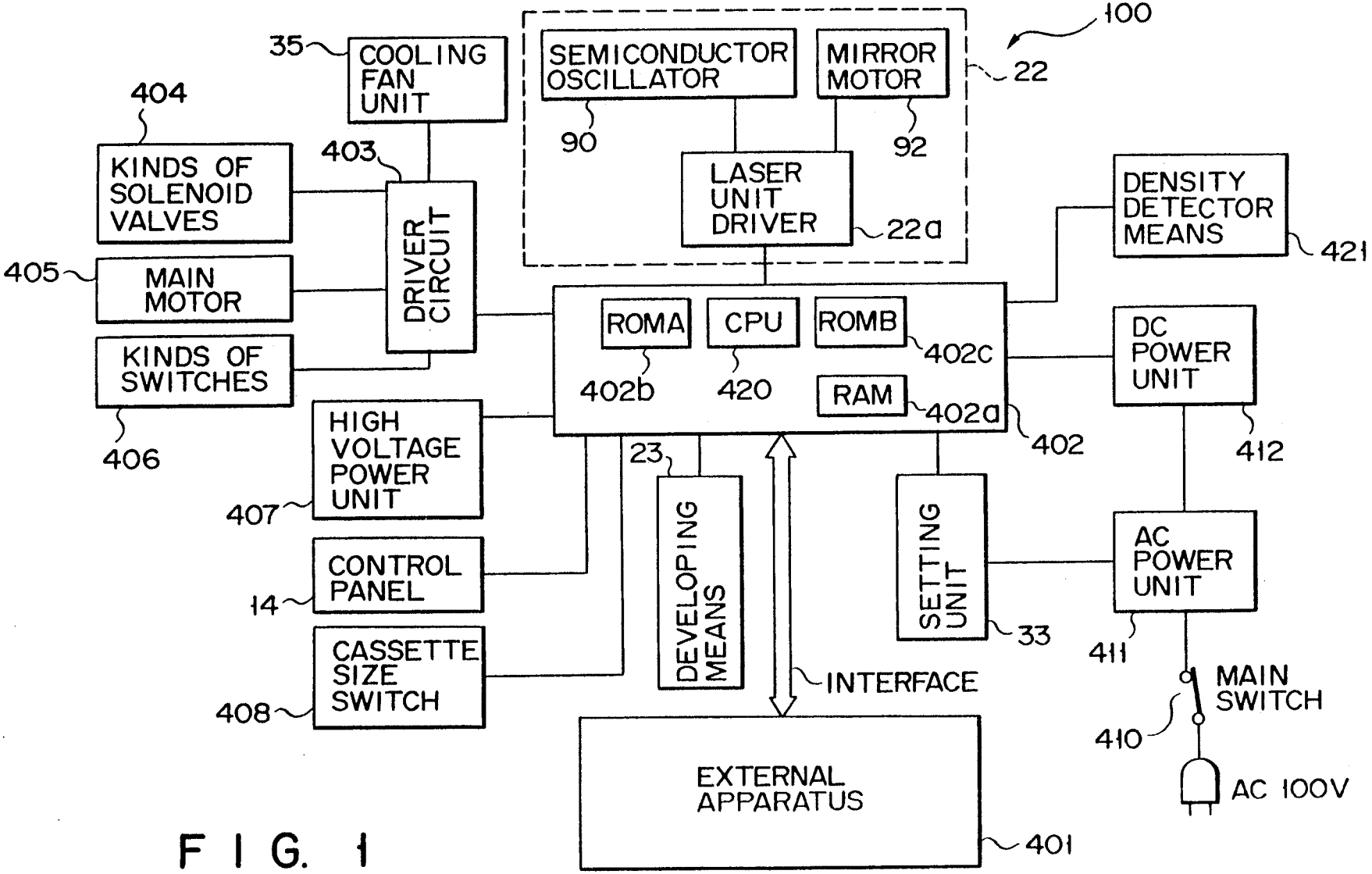
FIG. 1 is a block diagram showing an overall control system of an image forming apparatus according to an embodiment of the present invention.
Figure 2:
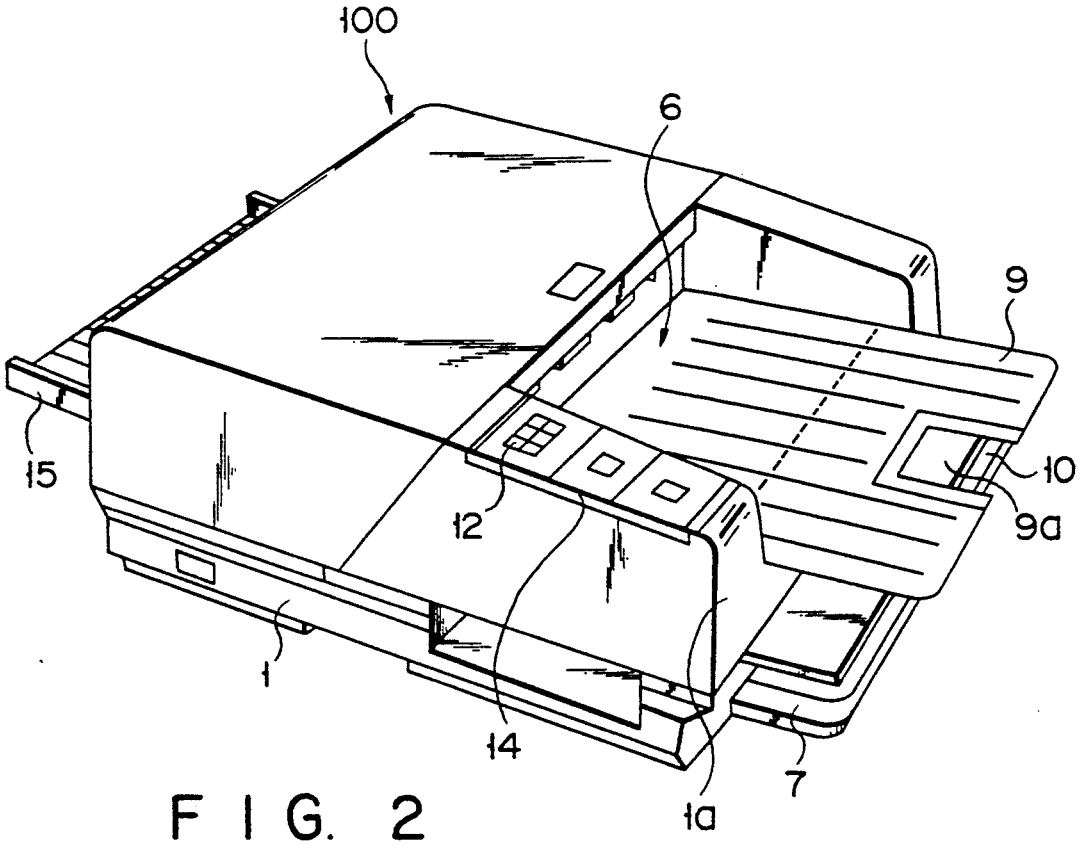
FIG. 2 is a perspective view showing an outer appearance of the same.
Figure 3:
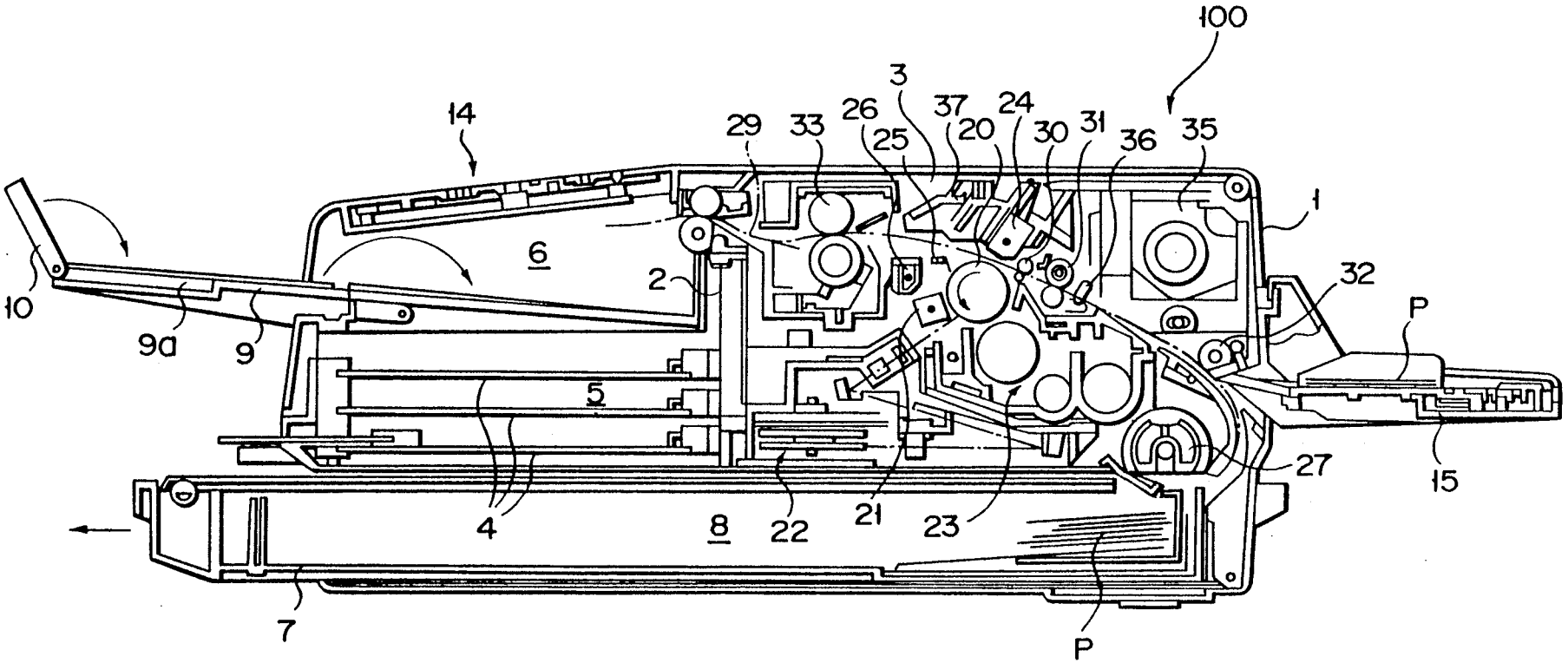
FIG. 3 is a longitudinal sectional side view of the same.

An image forming apparatus 100 shown in FIGS. 1 to 3 is of a type used as, e.g., a laser printer, and is coupled to a host system as an external output unit, e.g., a computer and a word processor, via a transmission controller such as an interface circuit. Upon reception of a print start signal from the host system, the apparatus 100 starts image recording operation, and records an image on a sheet P as a transfer medium and outputs the recorded sheet.

Referring to FIGS. 2 and 3, reference numeral 1 denotes an apparatus main body. A main control board 2 is arranged at the central portion inside the apparatus main body 1. An electrophotographic process unit 3 for forming an image is arranged behind (the right side in FIG. 3) the main control board 2. An external unit housing section 5 for housing a plurality of additional function control boards 4 (referred to as a controller or an external unit 401) is formed in the lower front portion of the apparatus main body 1. A paper discharge section 6 is formed in the upper front portion of the apparatus main body 1.

The lower portion inside the apparatus main body 1 forms a cassette housing section 8 for housing a paper cassette 7.

The paper discharge section 6 is constituted by recesses formed on the upper front surface of the apparatus main body 1, as shown in FIG. 2. A paper discharge tray 9 is rotatably provided on the front end of the paper discharge section 6 such that it can be folded on or extended from the paper discharge section 6.

Figure 11:
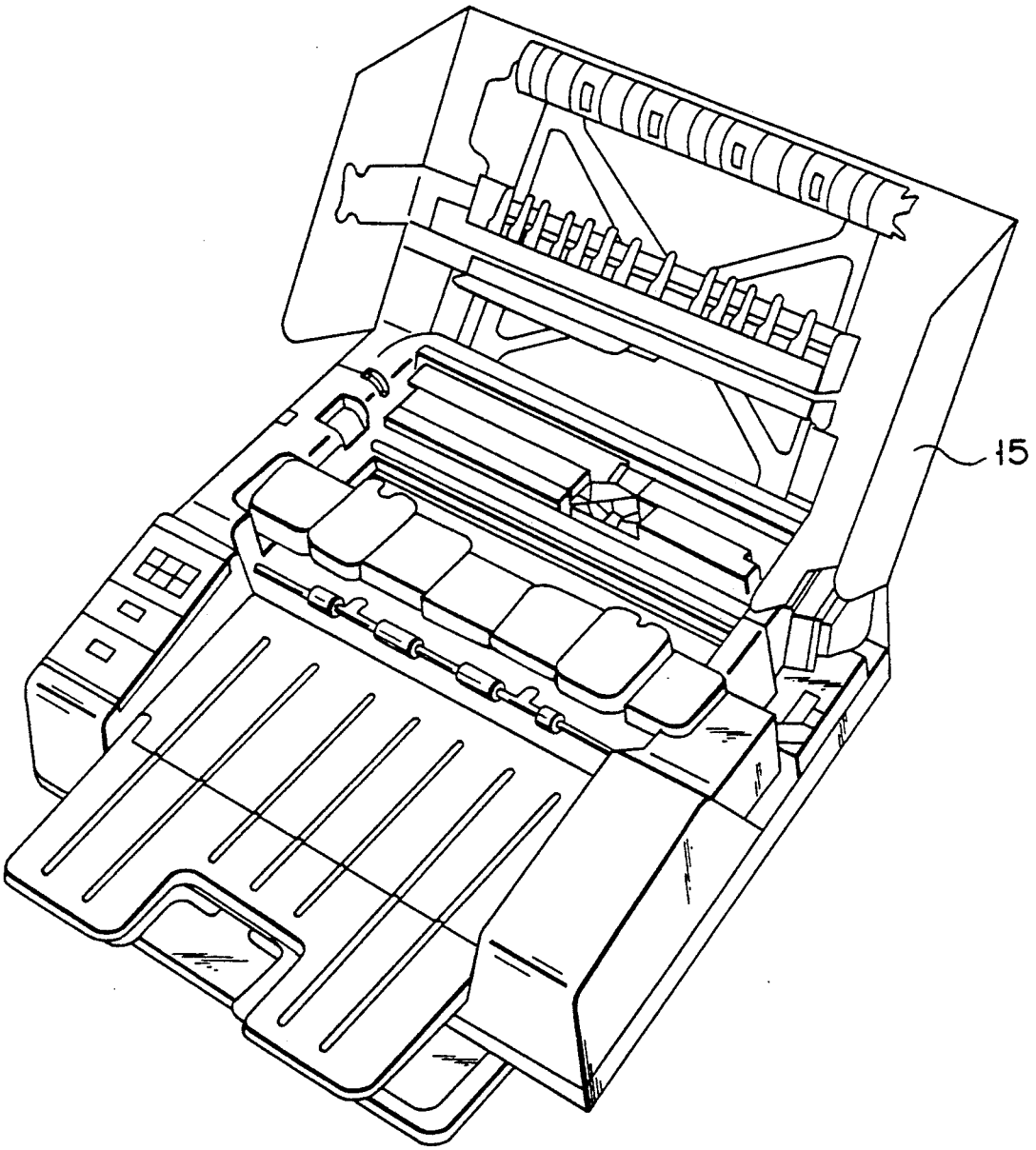
FIG. 11 is a perspective view showing the outer appearance of the present invention with an opening of the manual feed tray.
Figure 12:
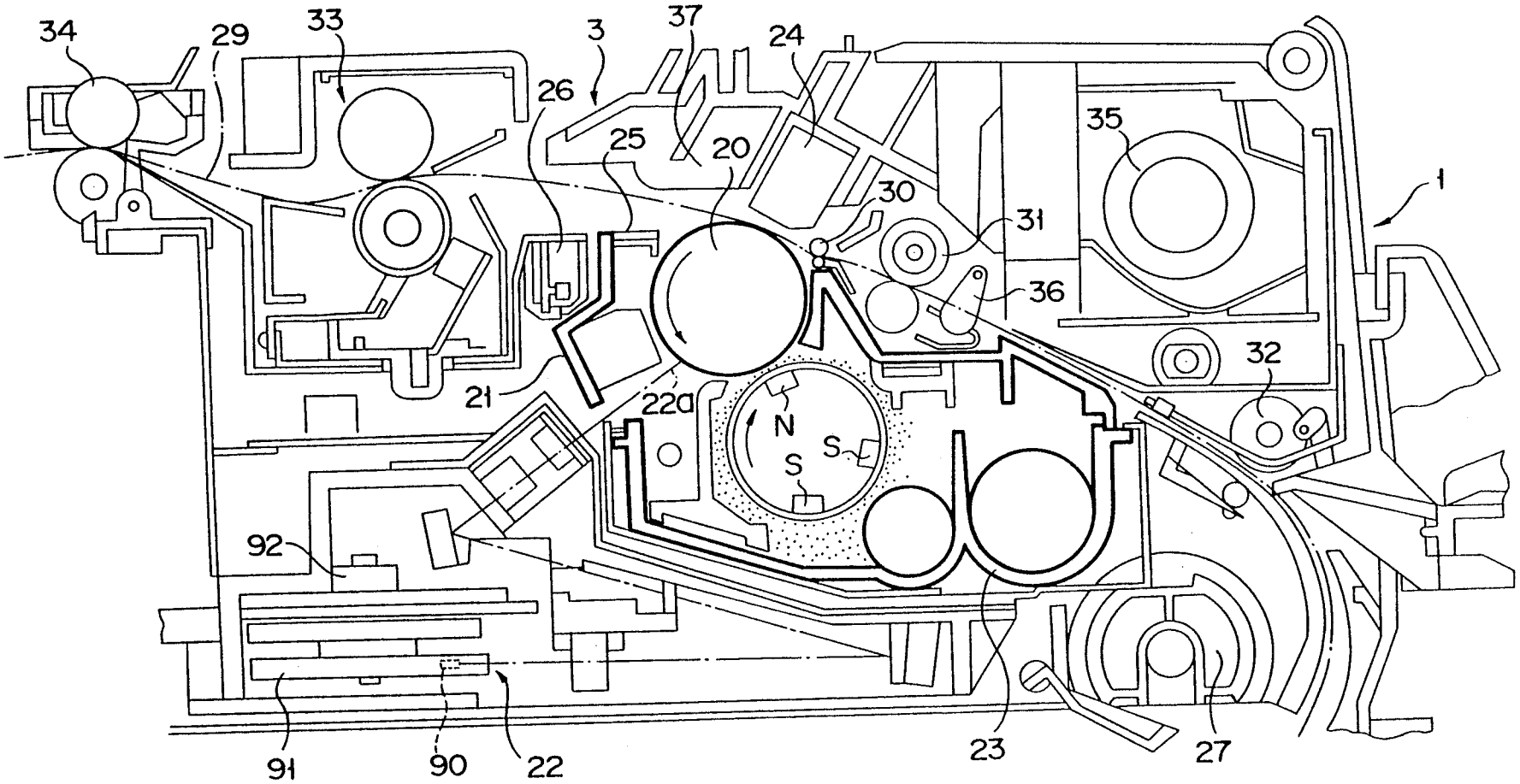
FIG. 12 is a detailed longitudinal sectional side view of a mechanical part of above FIG. 3.

A notch 9a is formed in the central portion of the front end of the paper discharge tray 9, and a U-shaped auxiliary paper discharge tray 10 is also rotatably provided in the central portion of the front end of the paper discharge tray 9 such that it can be housed in the notch 9a or extended as shown in FIG. 3, FIG. 11 and FIG. 12.

The size of the paper discharge section 6 can be adjusted in accordance with the size of the sheet P to be discharged.

A control panel 14 is arranged on the upper surface of a left-side frame 1a of the apparatus main body 1 which is located on the left side of the paper discharge section 6. A manual feed tray 15 is arranged in the rear surface of the apparatus main body 1.

The electrophotographic process unit 3 will be described with reference to FIG. 3.

The electrophotographic process unit 3 has a photosensitive drum 20 as an image carrier. An electrostatic charger 21 comprising a SCOROTRON, an exposing member or a laser unit driver 22a of a laser exposing unit 22 as an exposing means (electrostatic latent image forming means), an magnetic brush-type developing means 23 which performs developing and cleaning simultaneously, a transfer charger 24 comprising a SCOROTRON, a memory removing brush 25 comprising a brush member, and a front exposure lamp 26 are sequentially arranged around the photosensitive drum 20.

A paper convey path 29 is formed in the apparatus main body 1. When a sheet P is supplied from the paper cassette 7 through the paper feed means 27, or from the manual feed tray 15, it is guided to the paper discharge section 6, formed on the upper surface side of the apparatus main body 1, along the paper convey path 29 through an image transfer section 28 located between the photosensitive drum 20 and the transfer charger 24.

A pair of convey rollers 30, a pair of aligning rollers 31, and a pair of convey rollers 32 are arranged along the paper convey path 29 on the upstream side of the image transfer section 28. A setting unit or fuser 33 and a pair of paper discharge rollers 34 are arranged along the paper convey path 29 on the downstream side of the image transfer section 28. A cooling fan unit 35 is arranged above the pair of convey rollers 32.

An process unit includes the photosensitive drum 20, the electrostatic charger 21, the laser unit driver 22a and the developing means 23 and so forth. This unit is indicated as a portion surrounded by bold lines as shown in FIG. 12. The process unit is one body as a mass of mechanical system. It is possible for an operator to install the process unit in the apparatus main body by opened the manual feed unit 15 as shown in FIG. 11. The operator can install the process unit through the opening of the feed unit 15.

The control system of the image forming apparatus 100 will be described with reference to FIG. 1.

The image forming apparatus 100 has a control means 402 for performing overall control. The control means 402 has a CPU 420 connected to a ROM 402a and a ROM 402c as two non-volatile memories, and to a RAM 402a.

The control means 402 receives a drive power through a main switch 410, an AC power source unit 411, and a DC power source unit 412.

The laser exposing unit 22, the developing means 23, and the setting unit 33 are connected to the control means 420. The control means 402 is connected to a driver circuit 403, a high voltage power unit 407, the control panel 14, and a cassette size switch 408.

The laser exposing unit 22 has the laser unit driver 22a, a semiconductor oscillator 90, and a mirror motor 92.

The driver circuit 403 drives various kinds of solenoid valves 404 including a toner supply solenoid valve 503 to be described later, a main motor 405, various switches 406 and the cooling fan unit 35.

The control means 402 is also connected to the external unit 401 through an interface. The control means 402 controls a density detecting means (toner sensor) 421 that detects the density of a toner t, constituting a two-component developer D together with a carrier c, of the developing means 23.

Figure 5:
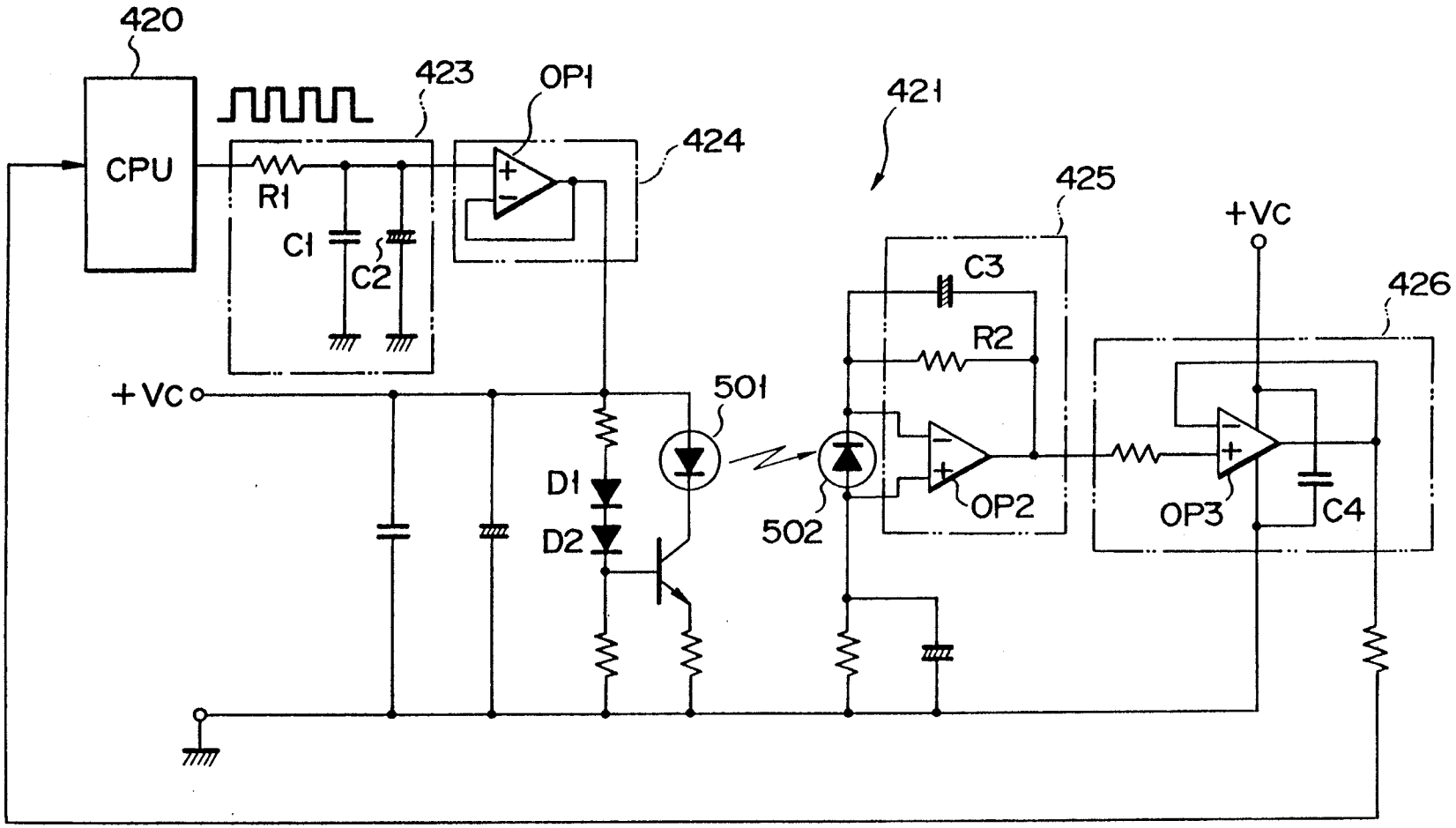
FIG. 5 is a circuit diagram of the density detecting means.

More specifically, as shown in FIG. 5, in the density detecting means 421, a rectangular pulse signal output from a CPU 420 is supplied to a light-emitting element 501 by an integrating/smoothing circuit 423, including a resistor $R_1$ and capacitors $C_1$ and $C_2$, and an amplifier 424 using an operational amplifier $OP_1$, as a predetermined current. Upon reception of the light from the light-emitting element 501, a light-receiving element 502 outputs a signal to a waveform shaper 425 having an operational amplifier $OP_2$, a capacitor $C_3$, and a resistor $R_2$. The signal waveform-shaped by the waveform shaper 425 is amplified by an amplifier 426, including an operational amplifier $OP_3$ and a capacitor C4, and fed back to the CPU 420.

Referring to FIG. 5, reference symbols $D_1$ and $D_2$ denote heat characteristic compensating diodes.

When the CPU 420 fetches the detection result of the toner t obtained by the density detecting means 421, it changes the period of the pulse signal to be output to the integrating/smoothing circuit 423 based on the detection result. As a result, the solenoid valve 503 is controlled, such that the detection result always falls within a predetermined range even when the developing means 23 is exchanged.

Figure 4:
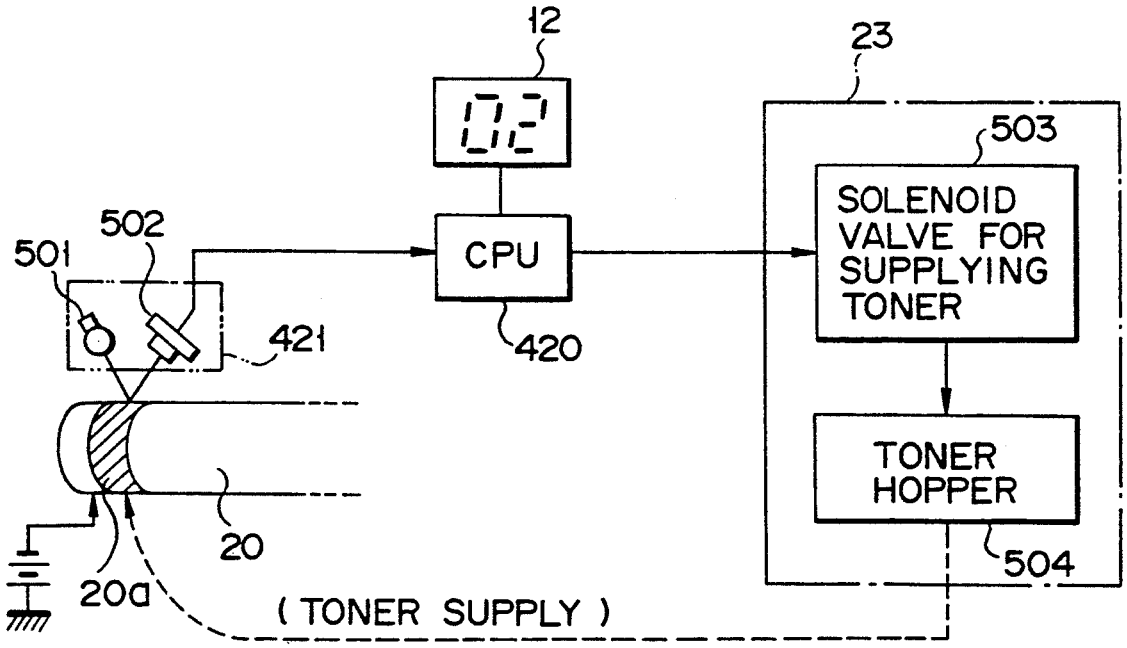
FIG. 4 is a block diagram showing a relationship between a density detecting means, a control means, and a developing means.

With this arrangement, as shown in FIG. 4, a drive signal output from the CPU 420 to the toner supply solenoid valve 503 of each developing means 23 is set to be a predetermined signal, so that the density of the toner t supplied to the photosensitive drum 20 through a toner hopper 504 becomes proportional to the detection result.

The detection result of the density detecting means 421 is stored in the ROM 402c.

FIG. 7 shows register allocation of the ROM 402c. The number of sheets P is counted in the following manner. The period of time during which the pair of aligning rollers 31 are rotated is counted in the ROM 402a. When the aligning rollers 31 convey a sheet P for a distance corresponding to the longer side of an A4-size sheet, TOTALC in the ROM 402c is incremented by one. Every time the count of TOTALC reaches 50, this count is stored in PRCSC0/PRCSC1, DVC0/DVC1, and FXC0/FXC1. In other words, the total number of printed A4 sidelong sheets is stored in TOTALC, and a corresponding base-50 number is stored in PRCSC0/PRCSC1, DVC0/DVC1, and FXC0/FXC1 as the total count, process unit life count, and the setting unit life count, respectively.

In accordance with the above counting method, when the count of the electrophotographic process unit 3 or the setting unit 33 reaches a predetermined value, the CPU 420 determines that it has reached its life end, and displays it to the user and simultaneously on the status of the interface. When a new electrophotographic process unit 3 is mounted and initialization of the density detecting means 421 is finished, DVC0/DVC1 is cleared to 0 to enable another printing. Simultaneously, counting of the electrophotographic process unit 3 is started again from 0.

When the setting unit 33 is exchanged for a new one, FXC0/FXC1 is cleared to 0. Data updating of the register EEPROM is guaranteed only up to 10,000 times. In contrast to this, the service life of the apparatus main body 1 itself corresponds to as many as count 300,000 to 500,000. Therefore, when TOTALC counts 10,000, it starts counting anew from 0 by an increment of 1, thus sequentially updating the address in units of 10,000 counts. Namely, one register is discarded every 10,000 count. When the address of a given register must be kept, it is stored in BANK00/BANK01. When an error occurs in a currently used register to disable writing, a next register is used. However, every time a defective register occurs, the count is increased in units of a maximum of 10,000. Therefore, the count of this defective register is stored in BANK10/BANK11 to save the data.

Density control of the toner t by the control means 402 will be described.

Light from the light-emitting element 501 of the density detecting means 421 is reflected by a probe 20*a* located beside the photosensitive drum 20 and is incident on the light-receiving element 502 to be inverted to a detection signal as an electric signal. The detection signal is then shaped by the waveform shaper 425 to have a smooth waveform, is amplified by the amplifier 426, and is fed back to the CPU 420.

The CPU 420 detects whether a new electrophotographic process unit 3 is mounted, determines the density of the toner t, and discriminates whether the toner t has run out or not, based on the detection signal which is fed back.

More specifically, as the result of the developing operation by the developing means 23, a toner in an amount proportional to the density of the toner t attaches to the probe 20*a*. The density control of the toner t is divided into four control levels. Namely, a toner density control target value is set first, and a control allowance level, an empty level, and a limit level are determined in a stepwise manner with reference to the toner density control target value (e.g., these three levels are set at the reference levels +7%, +13%, and +25%, respectively.) When the value of the detection signal falls between the control target value and the control allowance level, the detection signal is periodically sampled. Sampling of the detection value is constantly performed twice and the two detection values are compared to each other so that each value is compared twice. When a newly sampled detection value is larger than the old one, the toner t is replenished. When the detection value is smaller than the control target value, the toner t is not replenished. However, when the detection value exceeds the control allowance level, the toner t is replenished. When the detection value exceeds the empty level, it is determined as "toner empty". The amount of the toner to be replenished is not constant but is changed in the stepwise manner in accordance with a change in a detection value.

Figure 8:
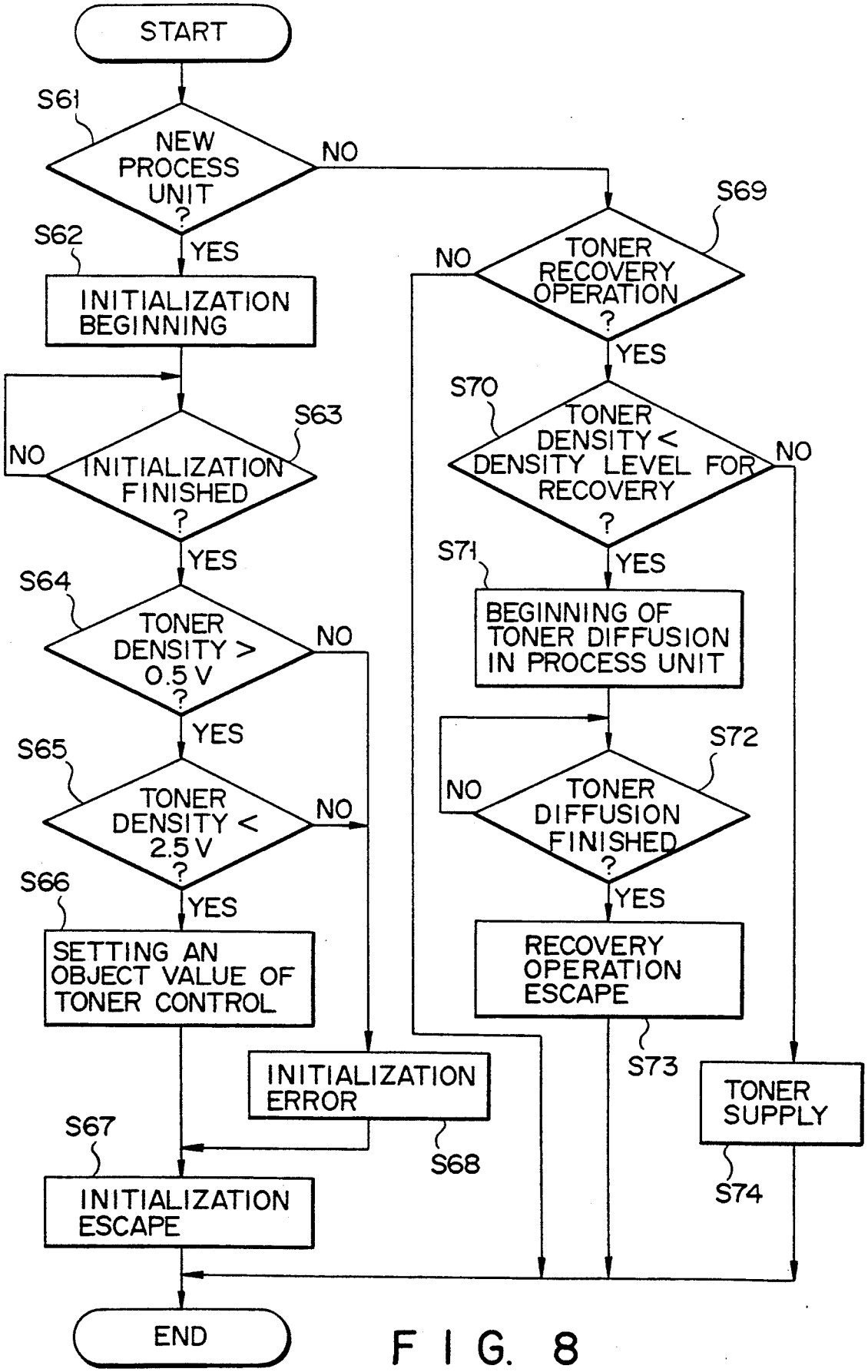
FIGS. 8 and 9 are flow charts respectively showing toner density control processing sequences.
Figure 9:
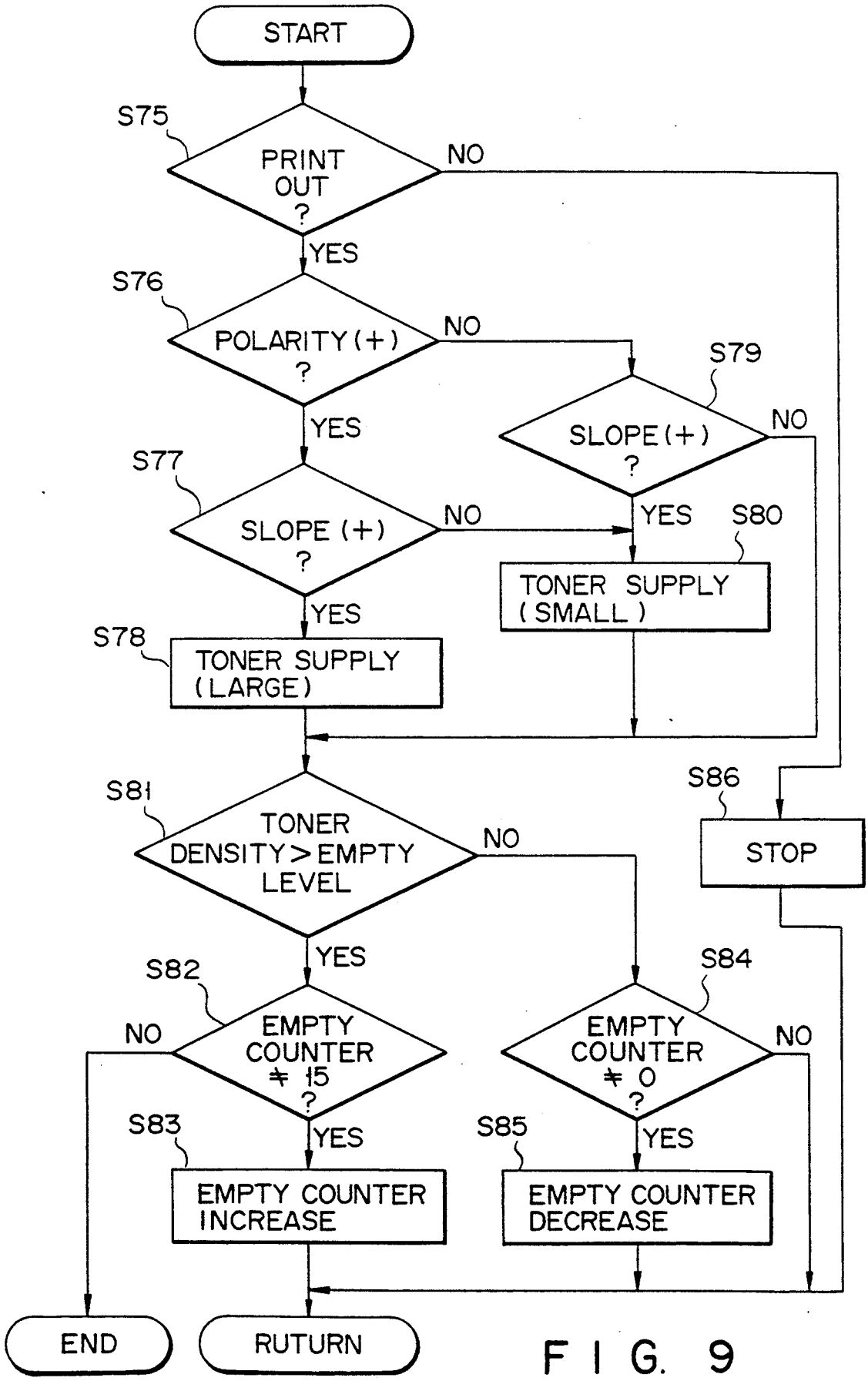

The above control operation will be described in detail with reference to FIGS. 8 and 9.

When a new electrophotographic process unit 3 is mounted in the apparatus main body 1, a detection switch (not shown) of the driver circuit 403 for detecting a new process unit is turned on. The main motor 405 is rotated, and, accordingly, the actuator of the new process unit 3 is moved to turn on the new process unit detection switch. In this case, when the switch-on state is kept for 0.4 seconds or more after the main motor 405 is turned on, and the switch-off state is kept for 0.4 seconds or more, it is determined that the new process unit 3 is present (S61). When the CPU 420 determines that the mounted electrophotographic process unit 3 is a new one, 3-minute initialization (aging) is started (S62). After initialization, when the toner attaching amount to the probe 20*a* is stabilized (S63, S64, and S65), the output from the density detecting means 421 is stored in TNSI0/TNSI1 of the ROMB 402*c* as the toner density control target value (S66). In other words, every time the electrophotographic process unit 3 is exchanged for a new one, the toner density control target value is updated. When the output value from the density detecting means 421 is abnormally large or small after the 3-minute initialization, it is determined as initialization error (S68), i.e., the new process unit 3 is a defective unit, a service call (2) is displayed, and a corresponding status signal is supplied to the external unit 401.

Then, initialization is stopped (S67).

When it is determined in S61 that the electrophotographic process unit 3 is not a new one, a recovery operation for the currently used unit 3 is performed (S69 to S74).

When the toner t is not recovered, it is discriminated whether or not a printing operation is being performed (S75). When a printing operation is ON and a rate of change in toner density shows a polarity and slope (S76 and S77), a large amount of toner is supplied by the toner supply solenoid valve 503 and the toner hopper 504 (S78). When the polarity state is not set but only the slope state is set, a small amount of toner is replenished (S79 and S80).

Then, it is discriminated whether or not the toner density is at the empty level (S81). When the toner density is greater than at the empty level, and when the empty counter is not 15, the empty counter is incremented (S82 and S83).

When the toner density level is less than the empty level and the empty counter is not 0, the empty counter is decremented (S85).

When it is determined that the printing operation is not ON (S75), the process is stopped (S86).

Figure 10:
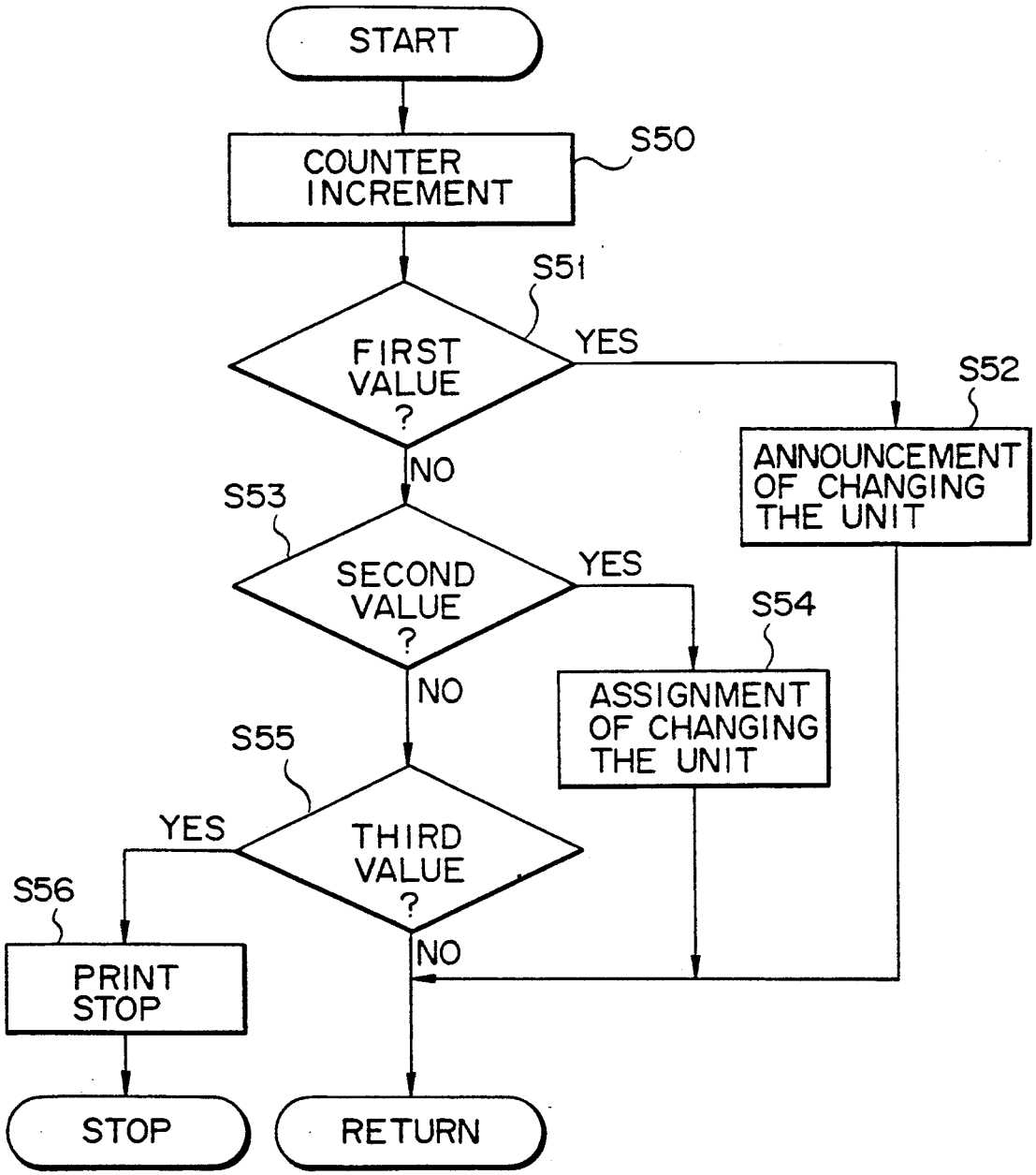
FIG. 10 is a flow chart for explaining unit exchange processing.

Exchange of the electrophotographic process unit 3 will be described with reference to FIG. 10 as well.

First, TOTALC provided in the ROMB 402*c* as the count area is incremented by one (S50). In this case, the TOTALC area as the increment target is an area next to an area designated by BANK00/BANK01. When the increment result is a multiple of 50, the PRCSC0/PRCSC1 area, the DVC0/DVC1 area, and the FXC0/TXC1 area are incremented. Then, it is discriminated whether or not the content of the DVC0/DVC1 area is a first predetermined value (S51). The first predetermined value is a value when the printing of 500 sheets is available before the life end of the electrophotographic process unit 3. For example, if the service life of the process unit 3 corresponds to 10,000 sheets, 9,500 is the first predetermined value. When it is determined that the content of the DVC0/DVC1 area is the first predetermined value, a unit exchange is announced (S62). In order to make this announcement, the introduction "02" flickers on the 7-segment display 12 of the control panel 14, to indicate operator calls (1) and (4).

On the other hand, when it is determined that the value of the DVC0/DVC1 area is not the first predetermined value, it is then discriminated whether or not it is a second predetermined value (S53). The second predetermined value is a value when the number of sheets reaches the life end of the electrophotographic process unit 3. For example, if the service life of the process unit 3 corresponds to 10,000 sheets, 10,000 is the second predetermined value. When it is determined that the count has reached the second predetermined value, unit exchange is informed (S54). In order to perform this assignment, the indication "51" on the 7-segment display 12 of the control panel 14, to indicate operator calls (1) and (4).

When it is determined that the count is not at the second predetermined value, it is then discriminated whether or not it has reached a third predetermined value (S55). The third predetermined value is the value when the electrophotographic process unit 3 is used over its service life by 500 sheets. For example, if the service life of the process unit 3 corresponds to 10,000 sheets, 10500 is the third predetermined value. When it is determined that the count is at the third predetermined value, the printing operation is stopped (S56).

As described above, during detection of the old/new electrophotographic process unit 3, when the current unit is detected to be a new one, a pulse signal having a predetermined period is supplied to the light-emitting element 501 shown in FIG. 5. The detection signal value fed back to the CPU 420 is compared with the toner density control target value. The CPU 420 supplies pulse signals in a stepwise manner so that the detection signal value falls within a range of the toner density control target ± several percent for a predetermined period of time. When the detection is finished within a predetermined period of time, the count of the pulse signals is stored in the ROMB 402*c* as the non-volatile memory, and is used for subsequent operation. When the detection is not finished within the predetermined period of time, the operator call (2) shown in FIG. 11 is generated. As a result, during assembly/adjustment of the apparatus main body 1, control of the developing means 23 as a reference by means of a volume is not needed, preventing degradation in job efficiency.

As has been described above in detail, according to the present invention, there is provided an image forming apparatus which is capable of automatic control of a developer density accompanying exchange of a developing means, thus performing image formation based on a constant stable developing operation.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

means, detachably mounted on the image forming apparatus, for supplying a developer to the image carrier to develop a latent image formed on the image carrier;

a process unit detachably mounted on the image forming apparatus and containing the image carrier and developing apparatus;

light generating means for generating a light to radiate the developer supplied on the image carrier by the supplying means;

means for discriminating whether or not a new process unit for forming the image has been mounted in the main body of the image forming apparatus;

means for generating a pulse signal to control the amount of the light generated by the light generating means, only when a discriminating means discriminates that a new process unit has been attached to the main body;

means for detecting the density of the developer supplied to the image carrier by detecting the light radiated onto the image carrier by the light generating means;

voltage generating means for generating a voltage value corresponding to the density of the developer detected by the detecting means;

means for changing the pulse width of the pulse signal generated by the pulse signal generating means in accordance with the voltage value generated by the voltage generating means;

means for controlling the supplying means to make the density of the developer supplied to the image carrier at a predetermined density value respond to the voltage value generated by the voltage generating means; and means for storing the pulse width of the pulse signal changed by the changing means when the density of the developer detected by the detecting means is the predetermined density value.

2. An apparatus according to claim 1, wherein the developer is a two-component developer, including a carrier and a toner.

3. An apparatus according to claim 3, wherein said density detecting means has means for detecting the density of each value twice and means for causing said second control means to replenish the toner only when the value of the density detected afterwards is larger by a predetermined value than that value detected first.

4. An apparatus according to claim 1, wherein the developer is a two-component developer, including a carrier and a toner.

5. An apparatus according to claim 4, wherein said density detecting means has a means for detecting the density of each value twice and means for causing said light generating means to replenish the toner only when a value of the density detected afterwards is larger by a predetermined value than that detected first.

6. An image forming apparatus comprising:

an image carrier;

means for supplying a developer to the image carrier to develop a latent image formed on the image carrier by the developing apparatus;

a process unit detachably mounted on the image forming apparatus and containing the image carrier and the developing apparatus;

means for generating a light to radiate the developer supplied on the image carrier by the supplying means of the process unit when the process unit is mounted on the image forming apparatus;

means for detecting the density of the developer supplied to the image carrier by detecting the light radiated on the image carrier by the generating means;

means for discriminating whether or not a new process unit for forming the image is mounted in the main body of the image forming apparatus;

first controlling means for controlling the density of the developer supplied from the developing means so as to make the density of the developer supplied to the image carrier a predetermined density value in accordance with the density of the developer detected by the detecting means;

second controlling means for controlling an amount of light generated by the generating means corresponding to the density of the developer detected by the detecting means when the first controlling means controls the density of the developer supplied from the supplying means, only when the discriminating means detects the attachment of a new process unit to the main body; and means for maintaining the amount of light generated by the generating means when the density of the developer detected by the detecting means is the predetermined density value.

7. An apparatus according to claim 6, wherein the developer is a two-component developer, including a carrier and a toner.

8. An apparatus according to claim 7, wherein said density detecting means has means for detecting the density of each value twice and means for causing said second control means to replenish the toner only when a value of the density detected afterwards is larger by a predetermined value than that detected first.

9. An image forming apparatus comprising:

an image carrier;

means for supplying a developer on the image carrier to develop a latent image formed on the image carrier;

a process unit detachably mounted on the image forming apparatus and containing the image carrier and the developing apparatus;

means for generating a light to radiate the developer supplied on the image carrier by the supplying means of the process unit when the process unit is mounted on the image forming apparatus;

means for detecting the density of the developer supplied on the image carrier by detecting the light radiated on the image carrier by the generating means;

first controlling means for controlling the density of the developer supplied from the developing means so as to make the density of the developer supplied on the image carrier at a predetermined density value responsive to the density of the developer detected by the detecting means;

second controlling means for controlling the amount of the light generated by the generating means corresponding to the density of the developer detected by the detecting means when the first controlling means controls the density of the developer supplied from the supplying means;

means for maintaining the amount of the light generated by the generating means when the density of the developer detected by the detecting means is the predetermined density value;

means for discriminating whether or not a new process unit for forming the image is mounted in an image forming apparatus main body, and if so, causing the toner to diffuse in said process unit for a predetermined period of time;

means for detecting the density of the toner and comparing a detected value with a predetermined value; and means for setting a control target value of the toner, or displaying that initialization is erroneous, depending on the comparison result.

* * * * *